US010537937B2

(12) United States Patent
Nishida et al.

(10) Patent No.: US 10,537,937 B2
(45) Date of Patent: Jan. 21, 2020

(54) POURING MACHINE AND METHOD

(71) Applicants: SINTOKOGIO, LTD., Aichi (JP); FUJIWA DENKI CO., LTD., Aichi (JP)

(72) Inventors: Tadashi Nishida, Aichi (JP); Toshiyuki Hyodo, Aichi (JP); Koichi Banno, Aichi (JP)

(73) Assignees: SINTOKOGIO, LTD., Aichi (JP); FUJIWA DENKI CO., LTD., Aichi (JP)

( * ) Notice: Subject to any disclaimer, the term of this patent is extended or adjusted under 35 U.S.C. 154(b) by 143 days.

(21) Appl. No.: 15/553,039

(22) PCT Filed: Mar. 6, 2015

(86) PCT No.: PCT/JP2015/056615
§ 371 (c)(1),
(2) Date: Aug. 23, 2017

(87) PCT Pub. No.: WO2016/142983
PCT Pub. Date: Sep. 15, 2016

(65) Prior Publication Data

US 2018/0029116 A1 Feb. 1, 2018

(51) Int. Cl.
*B22D 39/04* (2006.01)
*B22D 41/06* (2006.01)
(Continued)

(52) U.S. Cl.
CPC ..... *B22D 39/04* (2013.01); *B22D 37/00* (2013.01); *B22D 41/06* (2013.01); *B22D 47/00* (2013.01)

(58) Field of Classification Search
CPC ..... B22D 35/04; B22D 37/00; B22D 39/04; B22D 41/06; B22D 47/00
(Continued)

(56) References Cited

U.S. PATENT DOCUMENTS 3,685,573 A * 8/1972 Domres ..... B22D 41/12 164/270.1
3,818,971 A * 6/1974 Schutz ..... B22D 39/04 164/155.1
(Continued)

FOREIGN PATENT DOCUMENTS

DE 3532763 A1 3/1986
JP 7-112270 5/1995
(Continued)

OTHER PUBLICATIONS

Extended European Search Report for corresponding EP Application No. 15884481.1 dated Jul. 9, 2018.
(Continued)

*Primary Examiner* — Scott R Kastler
*Assistant Examiner* — Michael Aboagye
(74) *Attorney, Agent, or Firm* — Finnegan, Henderson, Farabow, Garrett & Dunner, LLP

(57) ABSTRACT

A pouring machine is provided to constantly maintain the level of the surface of melt without a leak, or the like, to maintain a necessary and sufficient pouring rate. The pouring machine (1) that pours molten metal from a container into molds in a line comprises a bogie (10) that travels along the molds; a mechanism (20) for moving the container back and forth that moves the container perpendicularly to the direction that the bogie travels; a mechanism (40) for tilting the container that tilts the container; a weight detector (50) that detects the weight of molten metal in the container; a surface-of-melt detector (60) that detects the level at a pouring cup (110) of a mold (100); and a controller (70) that controls the angle of the tilt of the container by using the detected level and the detected weight.

11 Claims, 8 Drawing Sheets

(51) Int. Cl.
*B22D 47/00* (2006.01)
*B22D 37/00* (2006.01)

(58) Field of Classification Search
USPC ..... 222/590, 591, 604; 266/236, 99; 164/457, 155.1
See application file for complete search history.

(56) References Cited

U.S. PATENT DOCUMENTS

| | | | | |
|---|---|---|---|---|
| 5,758,714 | A * | 6/1998 | Sato | B22D 37/00 164/136 |
| 6,896,032 | B1 * | 5/2005 | Minor | B22D 37/00 164/136 |
| 8,875,960 | B2 * | 11/2014 | Terashima | B22D 37/00 222/604 |
| 2008/0196856 | A1 | 8/2008 | Terada et al. | |
| 2011/0031285 | A1 | 2/2011 | Terada et al. | |
| 2012/0150329 | A1 | 6/2012 | Hyoudo et al. | |
| 2015/0000860 | A1 | 1/2015 | Suzuki et al. | |

FOREIGN PATENT DOCUMENTS

| | | |
|---|---|---|
| JP | 9-239524 | 9/1997 |
| JP | 10-235453 | 9/1998 |
| JP | 3361369 | 1/2003 |
| JP | 2010-519041 | 6/2010 |
| JP | 2012-166271 | 9/2012 |
| JP | 2013-544188 | 12/2013 |

OTHER PUBLICATIONS

International Search Report issued by the Japan Patent Office in International Application No. PCT/JP2015/056615, dated May 26, 2015 (2 pages).

* cited by examiner

POURING MACHINE AND METHOD

TECHNICAL FIELD

The present invention relates to a pouring machine and method to pour molten metal into molds. Specifically, it relates to an automatic pouring machine and method to pour the molten metal into molds of various shapes at suitable pouring rates.

BACKGROUND ART

Goods that have been cast have various shapes. To improve productivity, the number of cavities in a mold, namely, multicavity molding, has been increased. Further, various combinations of goods are used. As a result, various patterns for pouring molten metal into molds are required. Thus controlling pouring rates is important.

For example, when the ladle capacity is 500 kg, the pouring weight, the pouring time, and the pouring rate are generally set to be 10 to 50 kg, 4 to 12 seconds, and 1 to 5 kg/second, respectively. When the ladle capacity is 1,000 kg, they are generally set to be 30 to 150 kg, 6 to 15 seconds, and 5 to 10 kg/second. The pouring operations are complicated, but must be accurate. Incidentally, the term "pouring weight" means the weight of the molten metal that has been poured into a mold, and the term "pouring rate" means the flow rate of the molten metal that is being poured from a ladle into a mold.

Conventionally, an automatic pouring method has been known by which molten metal is poured by adjusting the angular velocity so as to tilt a ladle at a predetermined angle by means of feedback control. The predetermined angle is determined so as to follow a pouring pattern that is based on the pouring that is actually carried out by a skilled operator (see Japanese Patent No. 3361369, Japanese Patent Laid-open Publication No. H09-239524, and Published PCT Japanese Translation No. 2013-544188). By the method disclosed by Japanese Patent No. 3361369, the angular velocity to tilt a ladle is corrected by a correction factor that is preliminarily stored so as to maintain the constant pouring rate. By the method disclosed by Japanese Patent Laid-open Publication No. H09-239524, during the final part of the pouring the pouring weight is detected or the level of the surface of melt at a sprue is detected by means of a camera for image processing, so as to stop the pouring. By the method disclosed by Published PCT Japanese Translation No. 2013-544188, pouring patterns for various molds are easily determined by using a pouring weight, a pouring time, and a predetermined pouring pattern. These methods that are disclosed by the prior-art publications are only effective for the particular problems. However, they are not sufficient to automatically control the pouring rate.

By a typical and conventional pouring, molten metal is poured into a sprue for about two seconds by increasing the pouring rate so as not to spill it, so that the gating system is filled with the molten metal. After the molten metal starts to fill the cavity, the pouring rate is adjusted to follow the flow of the molten metal to the cavity while the sprue is watched so that no molten metal spills out. A skilled operator stops the pouring by judging the completion of the pouring based on his or her experience.

However, understanding the progress of the pouring is difficult. If the flow is too little, the temperature of the molten metal decreases or the shapes of molds change, to cause a misrun. On the other hand, if the flow is too great, the molten metal scatters or overflows. Further, estimating the amount of the molten metal that flows into a cavity is difficult. The pouring rate is generally reduced to prevent overflow, so that the pouring time become longer. This operation directly and negatively affects the productivity.

If the operation of the pouring from the beginning to the end of the pouring is controlled only by a deviation between the predetermined pouring pattern and the actual measurements, the delay in the change of the pouring rate causes the molten metal to leak, to overflow, or to have a short run.

If the pouring rate is controlled only by means of the flow of the molten metal into the cavity by using a model based on the relationship between an elapsed time and a flow rate that is based on the flow of the molten metal into the cavity, the operation tends to be carried out so as to ensure safety, so that the pouring time may be lengthened or so that the temperature of the molten metal decreases. Further, no deterioration of the nozzle of the ladle can be dealt with.

To enhance productivity there are strong requirements to shorten the pouring time and to increase the pouring rate. Thus a leak of the molten metal in which the molten metal leaks from the sprue or the molten metal overflows is highly possible. Further, the decrease in the temperature of the molten metal, the adhesion of slag to the nozzle of the ladle, or changes of the shapes of the molds, cause the direction of the flow of the molten metal to change. Thus controlling the flow rate becomes difficult.

The present invention aims to provide a pouring machine and method by which the level of the surface of melt can be constantly maintained from the beginning to the end of the pouring and by which the pouring can be carried out for a proper pouring time without a leak of the molten metal, an overflow, a shrinkage, or a short run, to maintain a necessary and sufficient pouring rate.

DISCLOSURE OF INVENTION

In a pouring machine of the first aspect of the present invention, as in FIGS. 1 to 3, for example, the pouring machine 1 pours molten metal from a container 2 into molds 100 that are transported in a line. The pouring machine 1 comprises a traveling bogie 10 that travels along the molds 100 that are transported in a line. It also comprises a mechanism 20 for moving the container back and forth that is placed on the traveling bogie 10 and that moves the container 2 in a direction perpendicular to a direction that the traveling bogie 10 travels. It also comprises a mechanism 40 for tilting the container that is placed on the mechanism 20 for moving the container back and forth and that tilts the container 2. It also comprises a weight detector 50 that detects a weight of molten metal in the container 2. It also comprises a surface-of-melt detector 60 that is placed on the traveling bogie 10 and that detects a level of a surface of melt in a pouring cup 110 of a mold 100 that receives molten metal from the container 2. It also comprises a controller 70 that controls an angle T of tilt of the container 2 by using the level of the surface of melt that is detected by the surface-of-melt detector 60 and a weight of molten metal that is detected by the weight detector 50. Incidentally, in this specification wording such as "that is placed on the traveling bogie" means to be placed directly on the traveling bogie 10, or to be placed on the mechanism 20 for moving the container back and forth that is placed on the traveling bogie 10 or on a vertically moving machine 30 that is placed on the mechanism 20 for moving the container back and forth.

By that configuration, the angle of the tilt of the container can be controlled by using the level of the surface of melt that is detected by means of the surface-of-melt detector and the weight of the molten metal that is detected by means of the weight detector, namely, the weight of the molten metal that has been poured into the mold, to pour the molten metal into the mold. Thus the pouring machine can pour molten metal into a mold for a proper pouring time to maintain constant the level of the surface of melt from the beginning to the end of the pouring and to maintain a necessary and sufficient pouring rate without a leak of the molten metal, an overflow, a shrinkage, or a short run at the end of the pouring.

By a pouring machine of the second aspect of the present invention, as in FIG. 1, for example, in the pouring machine 1 the surface-of-melt detector 60 is an image sensor. By this configuration, the surface-of-melt detector takes a picture of the surface of melt so as to detect its level.

By a pouring machine of the third aspect of the present invention, as in FIGS. 1 and 4, for example, in the pouring machine 1 of the second aspect a taper 112 is formed on the pouring cup 110 so that the surface-of-melt detector 60 detects the level of the surface of melt based on an area of the surface of melt. By this configuration, since the picture of the pouring cup on which the taper is formed is taken by the image sensor, the level of the surface of melt can be accurately detected.

By a pouring machine of the fourth aspect of the present invention, as in FIGS. 1 to 3, for example, in the pouring machine 1 of any of the first to third aspects the container 2 is a ladle that receives molten metal from a furnace and pours the molten metal into the molds 100. The vertically moving machine 30 that moves the ladle 2 up and down is placed on the mechanism 20 for moving the container back and forth. The mechanism 40 for tilting the container is placed on the vertically moving machine 30. By this configuration, since the distance to the mold can be adjusted by means of the mechanism for moving the container back and forth and the difference between the mold and the container in height can be adjusted by means of the vertically moving machine, the mechanism for tilting the container can tilt the container to pour the molten metal into the mold while the position to pour the molten metal is accurately controlled.

By a pouring machine of the fifth aspect of the present invention, as in FIGS. 1 to 3 and FIG. 5, for example, in the pouring machine 1 of the fourth aspect the mechanism 20 for moving the container back and forth, the vertically moving machine 30, and the mechanism 40 for tilting the container, coordinate with each other so that a tilting shaft 44 about which the container 2 is tilted by means of the mechanism 40 for tilting the container moves along an arc about a virtual point O that is set at or near a point where molten metal drops from a lip for pouring 6 of the container 2, so as to maintain a constant position where the molten metal is poured from the container 2 into the mold 100. By this configuration, since the tilting shaft of the container moves along an arc about the virtual point, the position where the molten metal is poured from the container into the mold can be constantly maintained. Thus the flow rate can be properly controlled.

By a pouring machine of the sixth aspect of the present invention, as in FIG. 6, for example, in the pouring machine 1 of any of the first to the fifth aspects the controller 70 stores a flow pattern that is suitable for the mold 100 (96). The flow pattern includes data on angular velocities to tilt the container 2 at each time interval and data on pouring weights at each time interval. The controller 70 controls the angle of the tilt of the container 2 (86) based on the angular velocity to tilt the container (85). By this configuration the pouring can be carried out at a proper pouring rate from the beginning to the end of the pouring.

By a pouring machine of the seventh aspect of the present invention, as in FIG. 6, for example, in the pouring machine 1 of the sixth aspect the controller 70 further stores a correction function to match the angular velocity to tilt the container of the flow pattern with a shape of the container 2 (95) so as to use a value that is obtained by multiplying the angular velocity to tilt the container by the correction function. By this configuration, when a container that has a different shape is used, the pouring can be carried out at a proper pouring rate.

By a pouring machine of the eighth aspect of the present invention, in the pouring machine 1 of the seventh aspect the controller 70 carries out feedforward control by using the value that is obtained by multiplying the angular velocity to tilt the container by the correction function and carries out feedback control by using the level of the surface of melt that is detected by means of the surface-of-melt detector 60 and a weight of the molten metal that is detected by the weight detector 50. By this configuration, the pouring machine can pour molten metal into a mold for a proper pouring time to constantly maintain the level of the surface of melt from the beginning to the end of the pouring and to keep a necessary and sufficient pouring rate without a leak of the molten metal, an overflow, a shrinkage, or a short run at the end of the pouring.

By a pouring machine of the ninth aspect of the present invention, as in FIG. 6, for example, in the pouring machine 1 of any of the first to eighth aspects the controller 70 calculates a correction to the angular velocity to tilt the container 2 (85) by using a difference (82) between data (96) on the pouring weight of the flow pattern and a weight of the molten metal in the container (87) that is detected by the weight detector 50, to control the tiling angle of the container (86). By this configuration, since the difference between the data on the pouring weight of the flow pattern and the weight of the molten metal in the container is used for the control, the proper pouring rate can be surely obtained.

By a pouring machine of the tenth aspect of the present invention, as in FIG. 6, for example, in the pouring machine 1 of the ninth aspect the controller 70 stores a correction factor for the pouring weight (93) to calculate the correction to the angular velocity to tilt the container 2 based on the difference in weight. It calculates the correction to the angular velocity to tilt the container 2 (85) by multiplying the difference in weight by the correction factor for the pouring weight (82). By this configuration, the correction to the angular velocity to tilt the container can be properly calculated based on the difference in weight.

By a pouring machine of the eleventh aspect of the present invention, as in FIG. 6, for example, in the pouring machine 1 of any of the first to tenth aspects the controller 70 calculates the correction to the angular velocity to tilt the container 2 (85) so that the level of the surface of melt that is detected by means of the surface-of-melt detector 60 is a predetermined level of the surface of melt (94) (84), to control the tiling angle of the container (86). By this configuration, since the difference between the predetermined level of the surface of melt and the detected level of the surface of melt are used for the control, the proper pouring rate can be surely obtained.

By a pouring machine of the twelfth aspect of the present invention, as in FIG. 6, for example, in the pouring machine 1 of the eleventh aspect the controller 70 stores the correction factor for the level of the surface of melt (93), which correction factor is used for calculating the correction to the angular velocity to tilt the container 2 based on the difference between the level of the surface of melt that is detected by means of the surface-of-melt detector 60 and the predetermined level of the surface of melt (94). It calculates the correction to the angular velocity to tilt the container 2 (85) by multiplying the difference in level (84) by the correction factor for the level of the surface of melt. By this configuration, the correction to the angular velocity to tilt the container can be properly calculated based on the difference in level of the surface of melt.

A pouring method of the thirteenth aspect of the present invention, as in FIG. 1 and FIG. 6, for example, comprises a step of tilting a container 2 to pour molten metal into a mold 100. It also comprises a step (87) of detecting a weight of molten metal within the container 2. It also comprises a step (84) of detecting a level of a surface of melt of a pouring cup 110 of the mold 100, which receives molten metal from the container 2. It also comprises a step (86) of controlling an angle of tilt to tilt the container 2 based on the detected weight and the detected level of the surface of melt.

By this configuration, since molten metal can be poured into the mold while the angle of the tilt of the container is controlled based on the detected weight and the detected level of the surface of melt, the level of the surface of melt can be maintained at a constant level from the beginning to the end of the pouring, while keeping a necessary and sufficient pouring rate without a leak of the molten metal, an overflow, a shrinkage, or a short run, at the end of the pouring.

By the pouring method of the fourteenth aspect of the present invention, as in FIG. 1 and FIG. 5, for example, in the pouring method of the thirteenth aspect, in the step of tilting the container 2 to pour molten metal into the mold 100 the container 2 is moved back and forth and also moved up and down so that a tilting shaft about which the container 2 is tilted moves along an arc about a virtual point O that is set at or near a point where molten metal drops from a lip for pouring 6 of the container 2, so as to constantly maintain a position where the molten metal is poured from the container 2 to the mold 100. By this configuration, since the tilting shaft of the container moves along an arc about the virtual point, the position where the molten metal is poured from the container to the mold can be constantly maintained. Thus the flow rate can be properly controlled.

By the pouring method of the fifteenth aspect of the present invention, as in FIG. 1 and FIG. 6, for example, in the pouring method of the thirteenth or fourteenth aspect a flow pattern (96) that is suitable for the mold 100 is used, wherein the flow pattern includes data on angular velocities to tilt the container 2 at each time interval and data on pouring weights at each time interval. The angle of the tilt of the container 2 is controlled (86) based on the angular velocity to tilt the container 2 (85). By this configuration the pouring can be carried out at a proper pouring rate from the beginning to the end of the pouring.

By the pouring method of the sixteenth aspect of the present invention, as in FIG. 1 and FIG. 6, for example, in the pouring method of the fifteenth aspect, a correction to the angular velocity to tilt the container 2 is calculated (85) by using a difference (82) between data (96) on the pouring weight of the flow pattern and a detected weight of the molten metal in the container 2 (87), and by using a difference (84) between a detected level of the surface of melt (83) and a predetermined level of the surface of melt (94), to control the angle of the tilt of the container 2 (86). By this configuration, since the difference between the data on the pouring weight of the flow pattern and the weight of the molten metal in the container and the difference between the predetermined level of the surface of melt and the detected level of the surface of melt are used for the control, the proper pouring rate can be surely obtained.

By the pouring machine and the pouring method of the present invention, molten metal can be poured into a mold for a proper pouring time to maintain the constant level of the surface of melt from the beginning to the end of the pouring and to maintain a necessary and sufficient pouring rate without a leak of the molten metal, an overflow, a shrinkage, or a short run at the end of the pouring.

The present invention will become more fully understood from the detailed description given below. However, the detailed description and the specific embodiments are only illustrations of the desired embodiments of the present invention, and so are given only for an explanation. Various possible changes and modifications will be apparent to those of ordinary skill in the art on the basis of the detailed description.

The applicant has no intention to dedicate to the public any disclosed embodiment. Among the disclosed changes and modifications, those which may not literally fall within the scope of the present claims constitute, therefore, a part of the present invention in the sense of the doctrine of equivalents.

The use of the articles "a," "an," and "the" and similar referents in the specification and claims are to be construed to cover both the singular and the plural form of a noun, unless otherwise indicated herein or clearly contradicted by the context. The use of any and all examples, or exemplary language (e.g., "such as") provided herein is intended merely to better illuminate the invention, and so does not limit the scope of the invention, unless otherwise stated.

BRIEF DESCRIPTION OF DRAWINGS

FIG. 4(*a*) shows a pouring cup that is shaped as a rectangle in a horizontal plane. FIG. 4(*b*) shows a pouring cup that is shaped as a circle in a horizontal plane. FIG. 4(*c*) shows the pouring cup and the mold.

FIG. 5(*a*) is a plan view. FIG. 5(*b*) is a side view. It shows the center for the movement.

MODE FOR CARRYING OUT THE INVENTION

Figure 1:
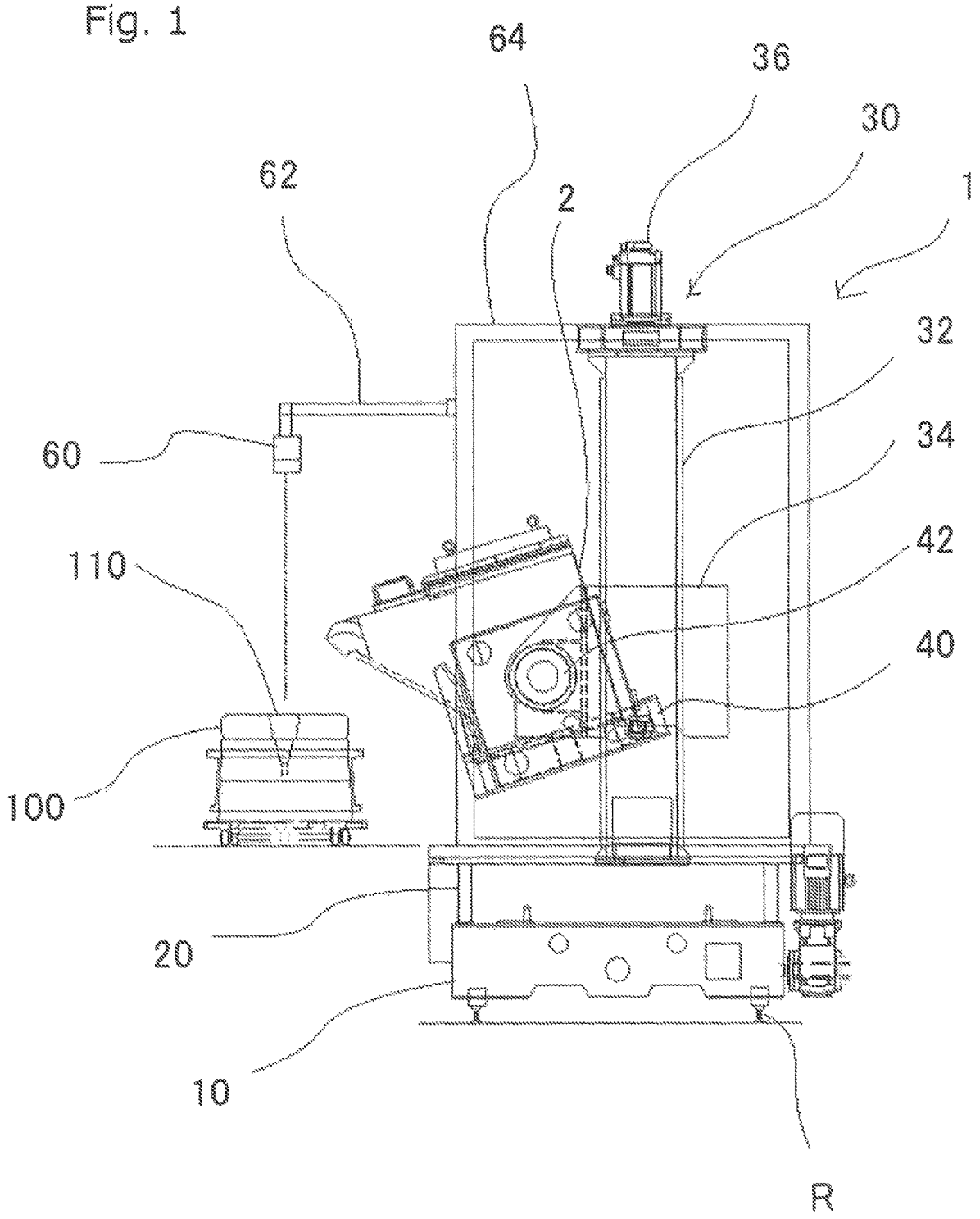
FIG. 1 is a front view of the pouring machine. It illustrates that molten metal is being poured from the ladle into the mold.

Below, an embodiment of the present invention is discussed with reference to the appended drawings. In the drawings, the same numeral or symbol is used for the elements that correspond to, or are similar to, each other. Thus duplicate descriptions are omitted.

Figure 2:
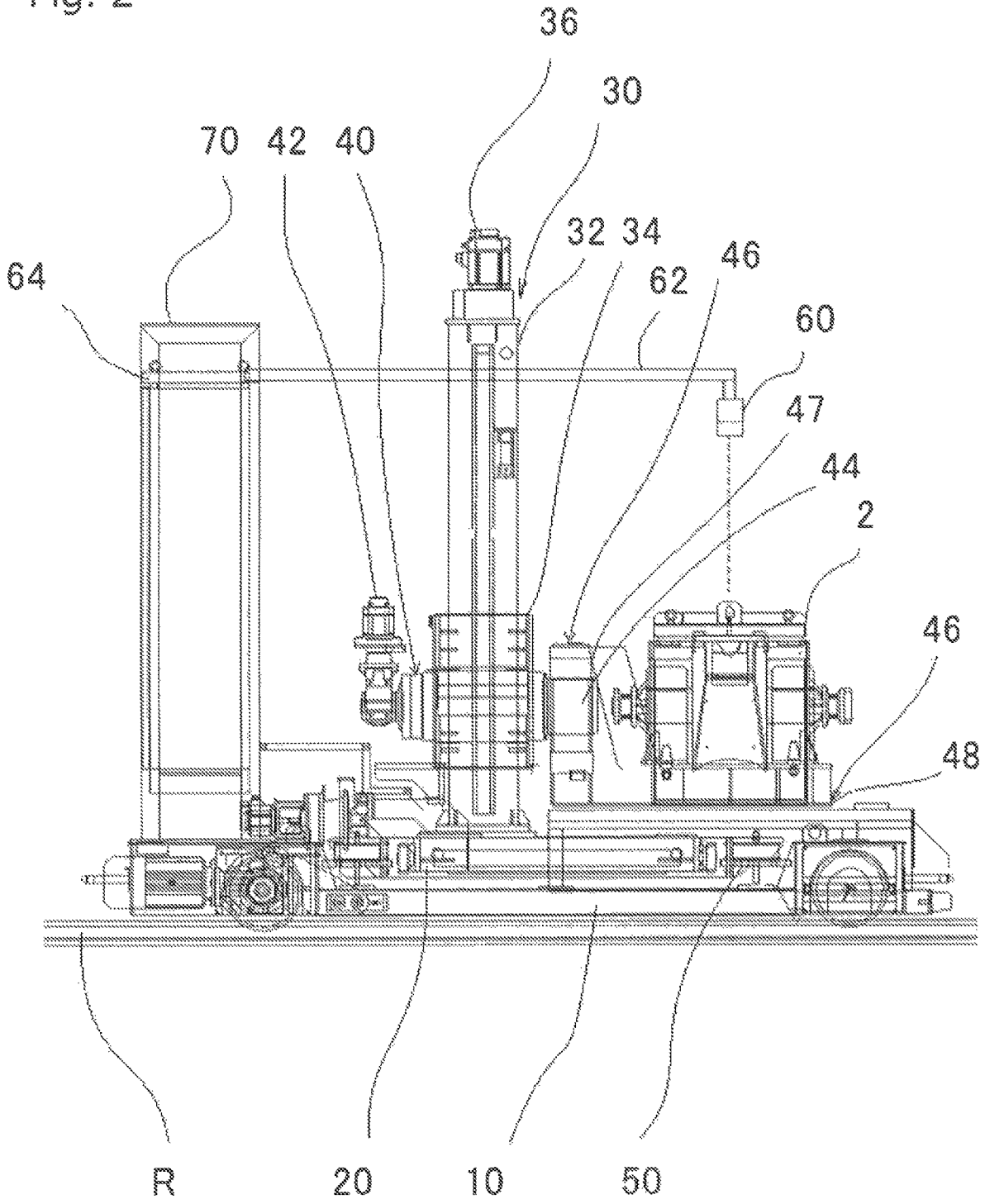
FIG. 2 is a side view of the pouring machine. It illustrates that the ladle has been lowered.
Figure 3:
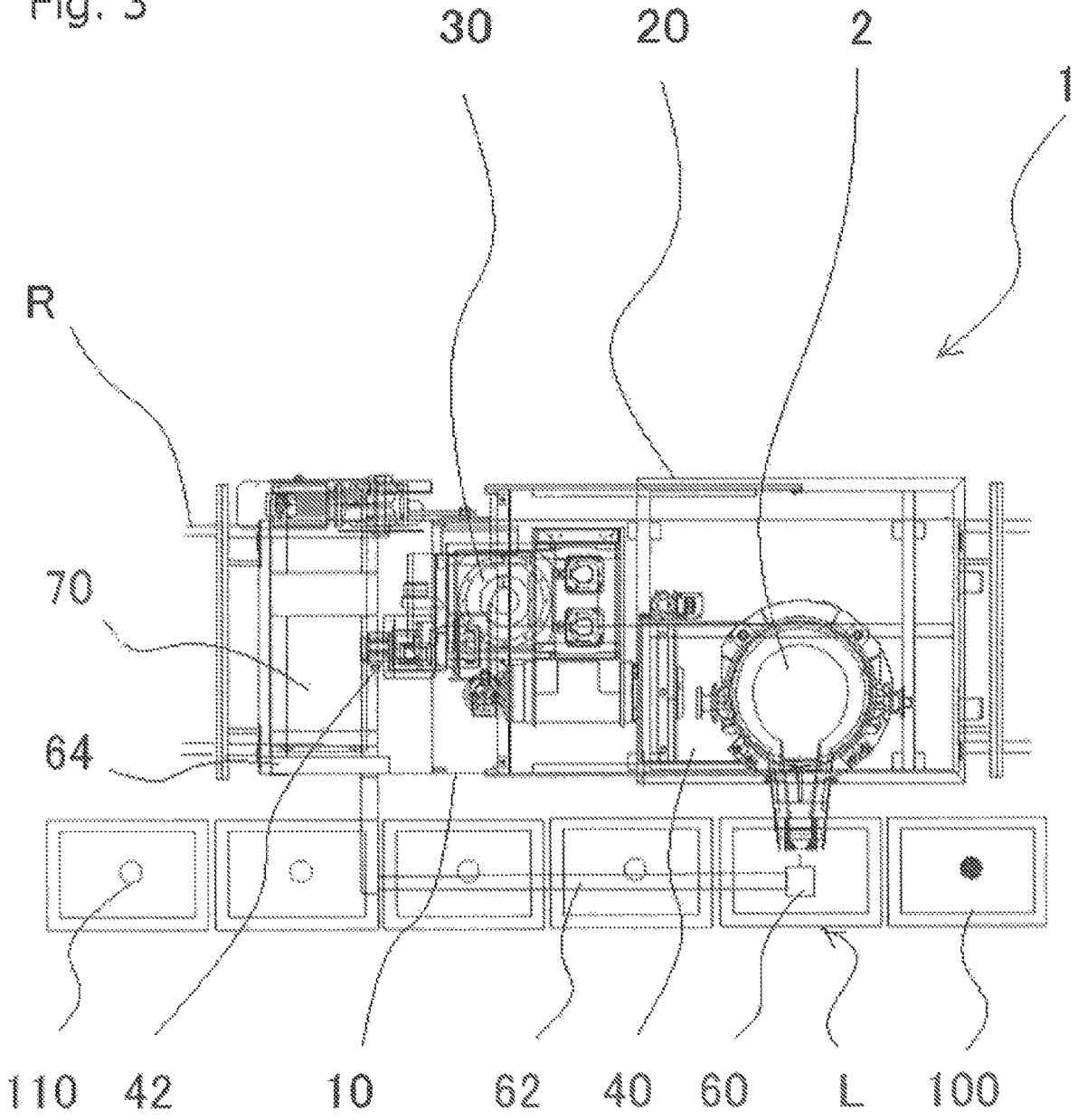
FIG. 3 is a plan view of the pouring machine.

FIG. 1, FIG. 2, and FIG. 3 are a front view, a side view, and a plan view, of a pouring machine 1, respectively, that pours molten metal from a ladle 2 into a mold 100. The pouring machine 1 comprises a traveling bogie 10 that travels on a rail R. It also comprises a mechanism 20 for moving the container back and forth that is placed on the traveling bogie 10 and moves in a direction perpendicular to a direction that the traveling bogie 10 travels. It also comprises a vertically moving machine 30 that is placed on the mechanism 20 for moving the container back and forth and moves the ladle 2 up and down. It also comprises a mechanism 40 for tilting the container that is placed on the vertically moving machine 30 and tilts the ladle 2. Further, it comprises a load cell 50 that is a weight detector to detect the weight of molten metal in the ladle 2. It also comprises a frame 64 that stands on the traveling bogie 10, an arm 62 for a camera that horizontally extends from the frame 64 and holds a camera 60 at a position that is appropriate for taking a picture of a pouring cup 110 of the mold 100, and the camera 60 that is a surface-of-melt detector and detects the level of the surface of melt at the pouring cup 110 of the mold 100 that receives the molten metal from the ladle 2. It also comprises a controller 70 that controls the operation of the pouring machine 1.

As is obvious from FIG. 3, the rail R is laid along a line of molds L on which molds 100 are transported. Thus the traveling bogie 10 travels along the line of molds L. Since the traveling bogie 10 can have any known structure, a detailed discussion on it is omitted. Generally, after molten metal is poured from the pouring machine 1 into a mold 100, the line of molds L moves by a distance that equals the length of a mold. Thus an empty mold 100 is placed in front of the pouring machine 1. Then molten metal is again poured into a mold 100. However, if moving the line of molds L by a distance that equals the length of a mold takes a long time, the pouring machine 1 may move on the rail R and the mold 100 may move on the line of molds L in the same direction and at the same speed as the pouring machine 1 does, while molten metal is being poured from the pouring machine 1 into the mold 100. Thus no time is wasted for moving the molds on the line of molds L by a length of a mold. In this case the pouring machine 1 returns over a distance that equals the length of a mold on the rail L to pour molten metal into a next mold. Alternatively, it may not return for each mold 100, but it may return by a length that equals the distance that the line of molds L moves after it pours a predetermined amount of molten metal into the molds 100.

The mechanism 20 for moving the container back and forth moves on the traveling bogie 10 in the direction perpendicular to a direction that the traveling bogie 10 travels, namely, a direction whereby it comes close to, or moves away from, the mold 100 or the line of molds L. It may be a bogie that travels on a rail that is laid on the traveling bogie 10. It may be a roller conveyor or some other structure.

The vertically moving machine 30 is placed on the mechanism 20 for moving the container back and forth and moves the ladle 2 up and down. In this embodiment it has a pillar 32 that stands on the mechanism 20 for moving the container back and forth. It also has a vertically moving body 34 that surrounds the pillar 32 and moves up and down along the pillar 32. The vertically moving body 34 is suspended by a chain (not shown) and the chain is wound by a driver 36 for moving the body up and down, such as a motor, which is located at the top of the pillar 32. Thus the vertically moving body 34 can be moved up and down. In FIGS. 1, 2, and 3 the mechanism 40 for tilting the container is moved up and down by using a cantilever that is supported by the pillar 32. However, for a large ladle, preferably two pillars 32 stand on the mechanism 20 for moving the container back and forth, and the mechanism 40 for tilting the container that is supported at both ends is moved up and down. The vertically moving machine 30 may be a pantograph-type machine (not shown). The structure for moving the body up and down is not limited to the above-mentioned ones.

The mechanism 40 for tilting the container is supported by the vertically moving machine 30 to be moved up and down. It tilts the ladle 2 so that molten metal is poured from the ladle 2 into a mold 100. A tilting shaft 44 of the mechanism 40 for tilting the container is supported by the vertically moving body 34 so as to be tilted about a horizontal axis. A table 46 for the ladle is supported at one end of the tilting shaft 44 so as to have the ladle 2 be mounted on it. The table 46 for the ladle has a side plate 47 that downwardly extends from the tilting shaft 44 and a bottom plate 48 that horizontally extends from the bottom of the side plate 47, to have the ladle 2 be mounted on it, so that the tilting shaft 44 comes close to the center of gravity of the ladle 2. A driver 42 for the tilting is connected to the other end of the tilting shaft 44 to tilt the tilting shaft. The driver 42 for the tilting may be, for example, a motor with a speed reducer. Incidentally, the tilting shaft 44, i.e., the table 46 for the ladle, may be tilted by means of hydraulic pressure. The type of power for the tilting is not limited.

The load cell 50 detects the weight of the molten metal in the ladle 2. The load cell 50 may be located, for example, at a position to weigh the mechanism 20 for moving the container back and forth. In this case the weight of the molten metal in the ladle 2 is detected by subtracting the weight of the mechanism 20 for moving the container back and forth, of the vertically moving machine 30, of the mechanism 40 for tilting the container, and of the ladle 2, from the weight that is measured by means of the load cell 50. The load cell 50 may be located at a position to weigh the traveling bogie 10, the vertically moving machine 30, the mechanism 40 for tilting the container, or the ladle 2.

The camera 60 takes a picture of the surface of melt at the pouring cup 110 so as to detect the level of the surface of melt at the pouring cup 110 of the mold 100 that is receiving molten metal from the pouring machine 1. It is supported by the arm 62 for the camera that horizontally extends from the upper part of the frame 64, which stands on the traveling bogie 10. The camera 60 is located at a position that is suitable for taking a picture of the surface of melt at the pouring cup 110. The position or angle of the camera 60 is preferably adjusted depending on the relationship between the position of the traveling bogie 10 and that of the pouring cup 110 of the mold 100. The arm 62 for the camera may be extended directly from the controller 70 without the frame 64. The camera 60 may be supported by some other type of structure.

Figure 4:
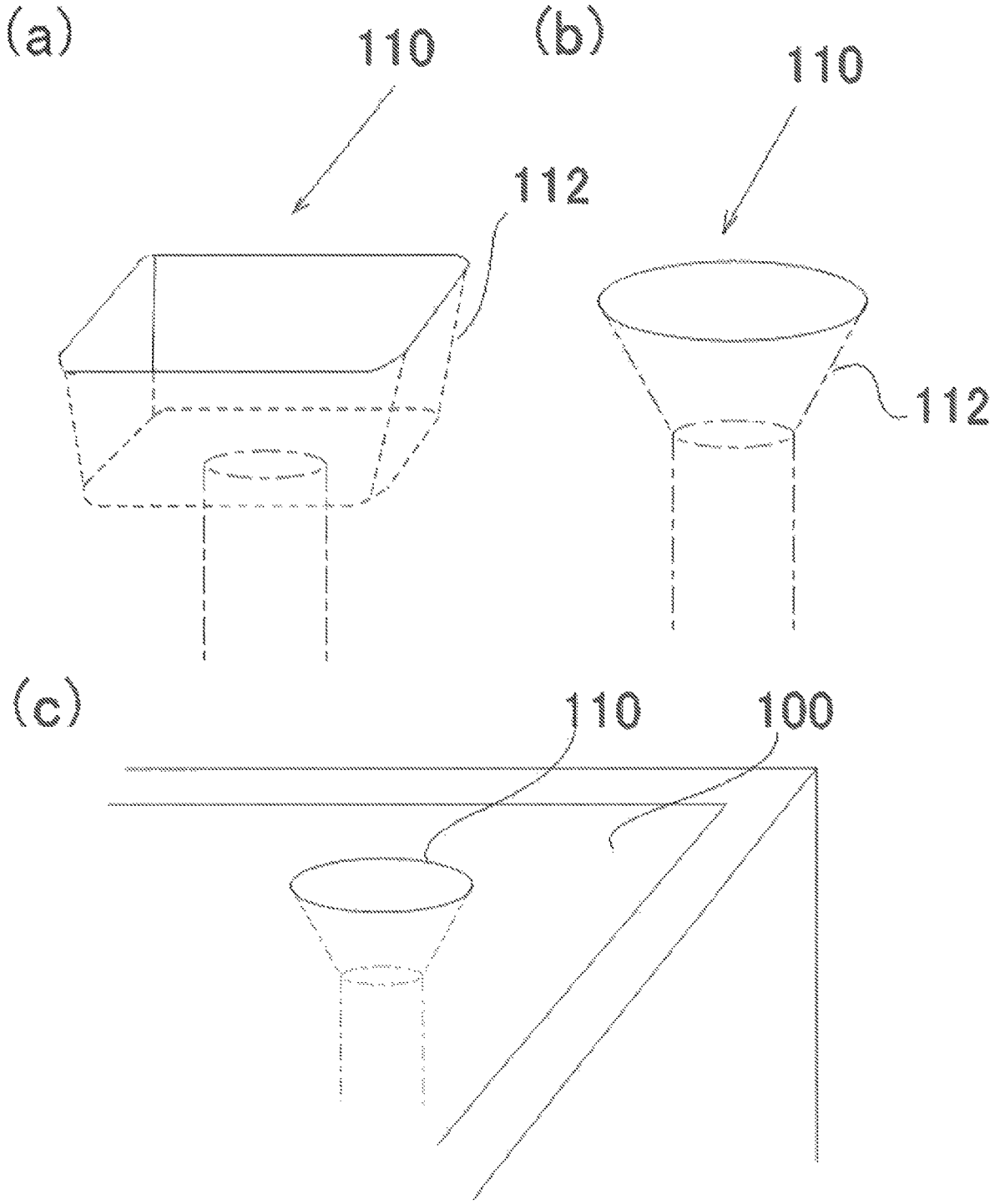
FIG. 4 illustrates the pouring cup.

As in FIG. 4, a taper is preferably formed on the pouring cup 110. The pouring cup 110 acts as a flow passage that is provided to the mold 100 and is the first vertical passage to receive poured molten metal, to introduce it into the mold 100. Since the taper is formed on the pouring cup 110, the level of the surface of melt can be easily detected based on the area of the surface of melt, of which a picture is taken by the camera 60. In so doing, the shape of the section of the pouring cup 110 is arbitrary, and may be a rectangle as in FIG. 4(*a*), a circle as in FIG. 4(*b*), or some other shape. However, a preferable shape is one by which the level of the surface of melt can be accurately detected based on the change of the area of the surface of melt. The position of the pouring cup 110 in the mold 100 is not necessarily at a center as in FIG. 3. It may be off-center as in FIG. 4(*c*). It varies with the molds 100. Thus the position or angle of the camera 60 is preferably adjustable.

The camera 60, which takes a picture of the surface of melt at the pouring cup 110, is preferably an image sensor, e.g., a CCD or a CMOS. However, the surface-of-melt detector 60 may be an infrared sensor or a laser sensor that detects the level of the surface of melt based on the distance between the surface-of-melt and the surface-of-melt detector 60, not on the area of the surface of melt.

The controller 70 controls the operation of the pouring machine 1. That is, it controls the traveling of the traveling bogie 10, the movement of the mechanism 20 for moving the container back and forth, the vertical movement of the vertically moving machine 30, the tilting of the mechanism 40 for tilting the container, the detection of the weight of the molten metal in the ladle 2 that is measured by means of the load cell 50, the detection of the level of the surface of melt based on the surface of melt, of which a picture is taken by means of the camera 60, and so on. The details of the control by means of the controller is discussed below. The controller 70 is generally placed on the traveling bogie 10, but may be placed at another position or placed directly on the site along the rail R.

Next, the functions of the pouring machine 1 are discussed. The pouring machine 1 receives the ladle 2, which stores molten metal, from a system for transporting molten metal (not shown) within the foundry. The molten metal includes an alloyed metal or an inoculant, depending on the intended use. Generally, after the vertically moving machine 30 has been lowered, the table 46 for the ladle is moved toward the system for transporting molten metal by means of the mechanism 20 for moving the container back and forth so that the ladle 2, which is transported by means of a conveyor for a ladle (not shown), is placed on the table 46 for the ladle. The ladle 2 may be placed on the table 46 for the ladle by means of a crane or the like.

The pouring machine 1 that has the ladle 2 be mounted on it is moved by means of the traveling bogie 10 to the predetermined position to pour molten metal into a mold 100. Then the ladle 2 is moved by means of the mechanism 20 for moving the container back and forth and by means of the vertically moving machine 30, to a position that is suitable for pouring molten metal into a mold. Then the mechanism 40 for tilting the container tilts the ladle 2 to start pouring molten metal into the mold 100.

The ladle 2 tilts about the tilting shaft 44, namely, it rotates to tilt. If the position of the tilting shaft 44 is fixed, the position from which the molten metal flows from the ladle 2 changes, depending on the angle of the tilt. If the position from which the molten metal flows changes, then the position to which the molten metal is poured into the mold 100 changes. Thus the ladle 2 is preferably moved back and forth and up and down by means of the mechanism 20 for moving the container back and forth and by means of the vertically moving machine 30, to constantly maintain the position where the molten metal is poured into the mold 100.

Figure 5:
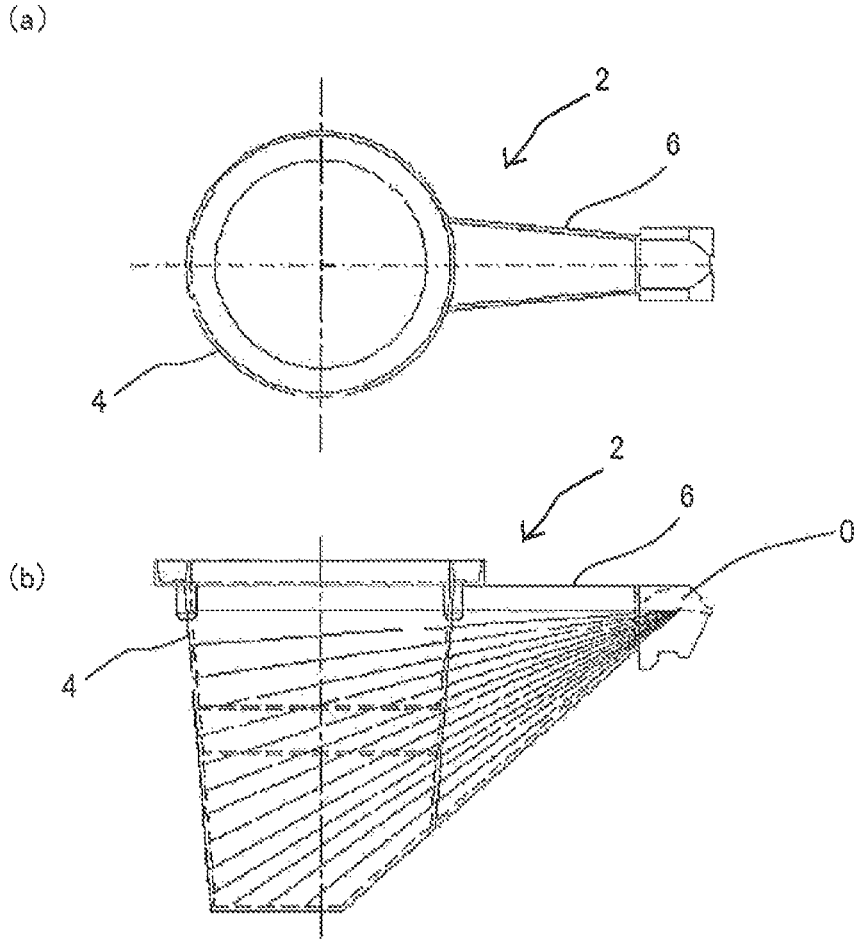
FIG. 5 illustrates the ladle.

An example of the ladle 2 is shown in FIG. 5. The ladle 2 has a body 4 that acts as a container to store molten metal and a lip for pouring 6 that acts as a flow passage that enables the molten metal to flow out of the ladle 2. When the ladle 2 is tilted, the molten metal flows from the tip of the lip for pouring 6. Thus a virtual center O for the movement is set at or near the point of the lip for pouring 6, where the molten metal drops. The ladle 2 is moved back and forth and up and down by means of the mechanism 20 for moving the container back and forth and by means of the vertically moving machine 30, so that the tilting shaft 44 moves along an arc about the center O for the movement as in FIG. 5(*b*), in which the surfaces of the molten metal are shown by fine lines. Thus, even though the ladle 2 moves, the relationship is constantly maintained between the point of the lip for pouring 6, where the molten metal drops from, and the position where the molten metal is poured into the mold 100. As a result, the position to pour the molten metal is constantly maintained at the position where the molten metal is poured from the ladle 2 into the mold 100. Incidentally, the position of the center O for the movement that is used to constantly maintain the position to pour the molten metal changes, depending on the shape of the ladle or the property of the molten metal.

About the pouring from the ladle 2 into the mold 100, the angle T of the tilt of the ladle is controlled from the beginning to the end of the pouring so as to properly maintain the pouring rate. Molten metal is basically poured into a mold based on the pouring pattern that has been preliminarily determined based on the pouring by a skilled operator. By using the flow pattern in this way, an almost perfect pouring rate can be easily ensured. By detecting the weight of the molten metal in the mold 100, the molten metal can be poured at a pouring rate that is nearer the predetermined flow pattern than the pouring that is controlled by only the angle T of the tilt of the mold 100. Since the actual weight of the molten metal that has been poured into the mold 100 is known, any possible overflow at the end of the pouring can be prevented and the pouring can be properly stopped. Further, since it is difficult to predict the flow of the molten metal into the cavity, the level of the surface of melt at the pouring cup 110 must be constantly maintained. Thus an overflow and a shortage of molten metal can be prevented.

Figure 6:
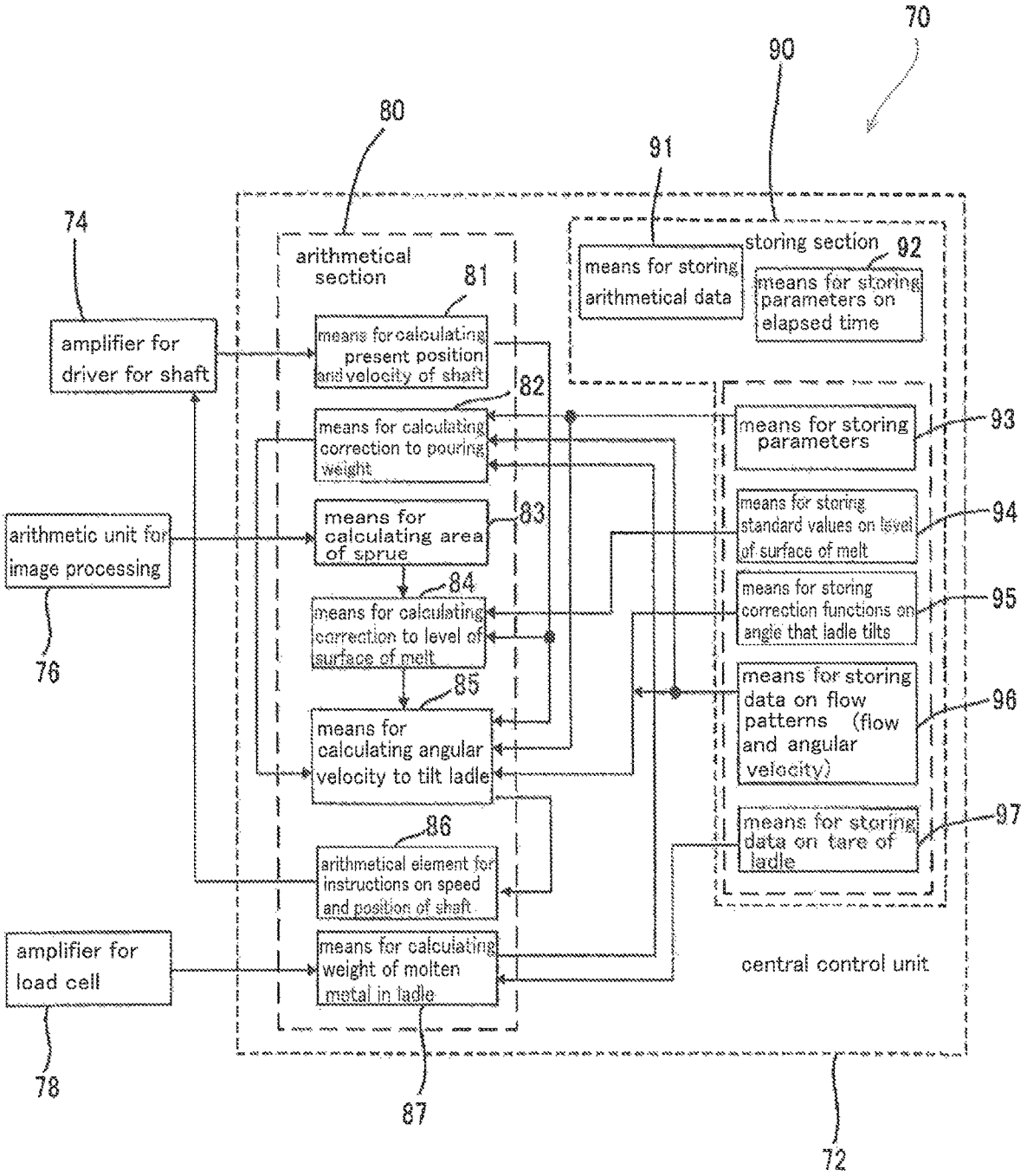
FIG. 6 illustrates the configuration of the controller.

With reference to FIG. 6, an example of the configuration of the controller 70 that is used to control the angle T of the tilt of the ladle is discussed. The controller 70 has a central control unit 72, an amplifier 74 for a driver for the shaft, an arithmetic unit 76 for image processing, and an amplifier 78 for the load cell. The amplifier 74 for a driver for the shaft amplifies signals transmitting instructions on operations that are sent from an arithmetical element 86 for instructions on the speed and position of the shaft of the central control unit 72 to the mechanism 20 for moving the container back and forth, to the vertically moving machine 30, or to the mechanism 40 for tilting the container. Below the arithmetical element 86 for instructions on the speed and the position of the shaft is discussed. The amplifier 74 sends instructions on the directions or speeds to move the ladle 2 to the devices. It also sends to the central control unit 72 signals transmitting the instructions or data on the directions or speeds to move the ladle 2, which data are measured by the devices. The arithmetic unit 76 for image processing manipulates the data on the image, which data have been captured by means of the camera 60. It processes the data from the camera 60 to send the processed data to the central control unit 72. The amplifier 78 for the load cell amplifies the voltage that is output by the load cell 50 to send the amplified voltage to the central control unit 72 as the weight detected by the load cell 50.

The central control unit 72 may be divided into an arithmetical section 80 and a storing section 90. The arithmetical section 80 has a means for operating. The storing section 90 has a means for storing data. Here, the means may be hardware, such as a circuit or an element, or a combination of hardware and software. The arithmetical section 80 includes a means 81 for calculating a present position and a velocity of the shaft, a means 82 for calculating a correction to the pouring weight, a means 83 for calculating the area of the sprue, a means 84 for calculating a correction to the level of the surface of melt, a means 85 for calculating an angular velocity to tilt the ladle, an arithmetical element 86 for instructions on the speed and the position of the shaft, and a means 87 for calculating the weight of the molten metal in the ladle.

The storing section 90 includes a means 91 for storing arithmetical data, a means 92 for storing parameters on the elapsed time, a means 93 for storing parameters, a means 94 for storing standard values on the level of the surface of melt, a means 95 for storing correction functions on the angle that the ladle tilts, a means 96 for storing data on the flow patterns, and a means 97 for storing the data on the tare of the ladle.

The means 91 for storing arithmetical data is used for temporarily storing the data to be calculated by the arithmetical section 80. The means 92 for storing parameters on the elapsed time, which is a timer, calculates the elapsed time. That is, it calculates the elapsed time tp from when the molten metal is poured from the ladle 2 into the mold 100. Further, it calculates the time after the molten metal is received by the ladle 2 and the elapsed time after the alloyed metal or the inoculants is added to the molten metal. Especially, the time after the alloyed metal or the inoculants is added is important for judging if any fading (the deterioration of the effect by the alloyed metal or the inoculants when a long time has passed after it is added) has occurred.

The means 93 for storing parameters stores the parameters on the shapes of the molds 100 and the parameters on the shapes of the ladles 2. It outputs the data to the means 82 for calculating any correction to the pouring weight, to the means 84 for calculating a correction to the level of the surface of melt, and to the means 85 for calculating an angular velocity to tilt the ladle.

The means 94 for storing standard values on the level of the surface of melt stores the standard values on the level of the surface of melt at the pouring cup 110. The standard values on the level of the surface of melt vary depending on the mold 100 and the properties of the molten metal. The data on the standard values are output to the means 84 for calculating a correction to the level of the surface of melt.

The means 95 for storing correction functions on the angle that the ladle tilts stores the correction function f(T) on the angle of the tilt. The correction function f(T) on the angle of the tilt represents the relationship between the angle T of the tilt for each kind of ladle and the pouring weight. The means 95 outputs the data to the means 85 for calculating an angular velocity to tilt the ladle.

The means 96 for storing data on the flow patterns stores the data on the flow pattern for each kind of mold and each kind of molten metal. The data on the flow pattern, such as the pouring weight, i.e., the weight of the molten metal in the ladle 2, at every moment of time, and the angular velocity to tilt the ladle, is stored. It outputs the data to the means 82 for calculating a correction to the pouring weight and the means 85 for calculating an angular velocity to tilt the ladle.

The means 97 for storing the data on the tare of the ladle stores the data on the weights of devices and equipment other than the molten metal, which weights are included in the weights that are detected by the load cell 50. The devices and equipment other than the molten metal include the ladle 2, the mechanism 20 for moving the container back and forth, the vertically moving machine 30, the mechanism 40 for tilting the container, and so on. It outputs the data to the means 87 for calculating the weight of the molten metal in the ladle.

The means 81 for calculating a present position and a velocity of the shaft calculates the position and velocity of the shaft of each device. It may calculate it based on the data on the movement of the ladle 2 that is measured by the mechanism 20 for moving the container back and forth, by the vertically moving machine 30, and by the mechanism 40 for tilting the container. Alternatively, it may calculate it based on the instructions on operations that are sent from the arithmetical element 86 for instructions on the speed and the position of the shaft, which element is discussed below, to the mechanism 20 for moving the container back and forth, to the vertically moving machine 30, or to the mechanism 40 for tilting the container. The calculated value, namely, the position and the angle of the tilt of the ladle 2 at the time, is output to the means 85 for calculating an angular velocity to tilt the ladle.

The means 82 for calculating a correction to the pouring weight calculates the difference between the weight of the molten metal in the ladle 2 that is detected by the means 87 for calculating the weight of the molten metal in the ladle, which means is discussed below, and the weight of the molten metal by the flow pattern that is sent by the means 96 for storing data on the flow patterns. Then it calculates the correction to the weight of the molten metal that is to be poured from the ladle 2 into the mold 100 based on the parameters of the shape of the ladle 2 and so on that are sent by the means 93 for storing parameters. It outputs the correction to the means 85 for calculating an angular velocity to tilt the ladle.

The means 83 for calculating the area of the sprue calculates the area of the sprue based on the image data that are sent by the arithmetic unit 76 for image processing to output the area to the means 84 for calculating a correction to the level of the surface of melt. The means 84 for calculating a correction to the level of the surface of melt calculates the level of the surface of melt based on the area of the sprue and the parameters on the shape of the pouring cup 110 that are sent by the means 93 for storing parameters. Then it calculates the correction to the level of the surface of melt based on the standard value that is sent by the means 94 for storing standard values on the level of the surface of melt to output the result to the means 85 for calculating an angular velocity to tilt the ladle.

The means 85 for calculating an angular velocity to tilt the ladle calculates an angular velocity to tilt the ladle 2 based on the position and the angle of the tilt of the ladle 2 at the time that they are sent by the means 81 for calculating a present position and a velocity of the shaft, the correction to the pouring weight that is sent by the means 82 for calculating a correction to the pouring weight, and the correction to the level of the surface of melt that is sent by the means 84 for calculating a correction to the level of the surface of melt. It outputs the calculated angular velocity to the arithmetical element 86 for instructions on the speed and the position of the shaft. To calculate the angular velocity to tilt the ladle 2, the parameters on the shape of the ladle 2, etc., that are sent by the means 93 for storing parameters, the correction function f(T) on the angle of the tilt that is sent by the means 95 for storing correction functions on the angle that the ladle tilts, and the angular velocity to tilt the container of the flow pattern that matches the mold 100, which flow pattern is sent by the means 96 for storing data on the flow patterns, are used. Incidentally, the calculations of the correction function f(T) on the angle of the tilt and the angular velocity to tilt the ladle 2 are discussed below.

The arithmetical element 86 for instructions on the speed and the position of the shaft calculates the instructions on operations to be sent to the mechanism 20 for moving the container back and forth, the vertically moving machine 30, and the mechanism 40 for tilting the container, based on the angular velocity to tilt the ladle 2 that is sent by the means 85 for calculating an angular velocity to tilt the ladle. It outputs the instructions to each device and to the means 81 for calculating a present position and a velocity of the shaft, via the amplifier 74 for a driver for the shaft.

The means 87 for calculating the weight of the molten metal in the ladle calculates the weight of the molten metal in the ladle based on the weights that are detected by the load cells 50, the data on which weights are sent by the amplifier 78 for the load cell, the data on the weight of the ladle 2 that is sent by the means 97 for storing the data the tare of the ladle, and the data on the weights that are sent by the mechanism 20 for moving the container back and forth, by the vertically moving machine 30, and by the mechanism 40 for tilting the container. It outputs the calculated weight to the means 82 for calculating a correction to the pouring weight.

Figure 7:
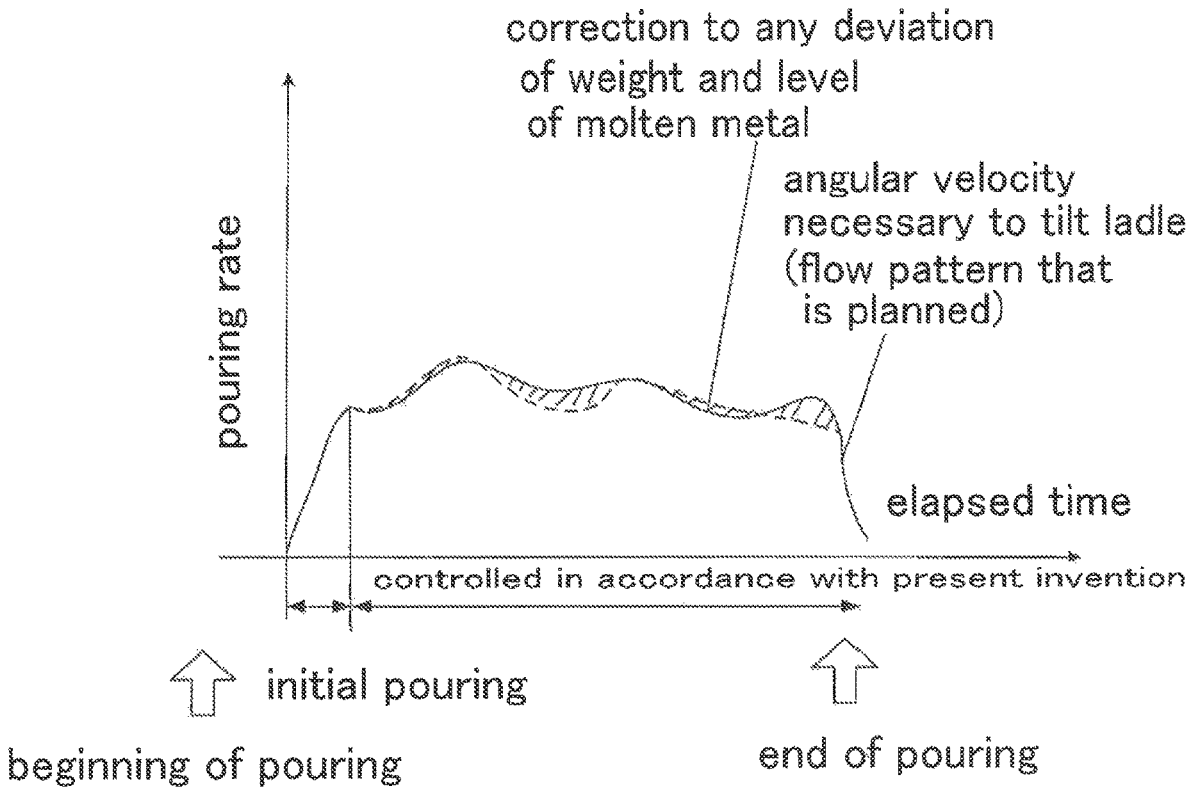
FIG. 7 illustrates the relationship between the elapsed time and the pouring rate.

With reference to FIG. 7, controlling the angle T of the tilt of the ladle 2 under the control of the controller 70 is now discussed. FIG. 7 illustrates a graph of the flow pattern by using the relationship between the elapsed time and the pouring rate. In the graph the elapsed time is shown on the abscissa and the pouring rate on the ordinate. In the graph the solid line shows the pouring rate from the ladle 2 into the mold 100. The dotted line shows the pouring rate based on the flow pattern.

In the initial pouring the molten metal is poured into the mold for a short period, i.e., about two seconds, by increasing the flow rate, but not enough to spill the molten metal from the pouring cup, to fill the pouring cup 110, the sprue, and a runner (collectively called the gating system) with the molten metal. In doing so the angle T of the tilt of the ladle 2 is determined based on the flow pattern. That is, the means 85 for calculating an angular velocity to tilt the ladle calculates by Equation (1) an angular velocity $V_{Tp}$ to tilt the container by the instructions at a time tp, which angular velocity is suitable for the ladle 2. That calculation is based on the data $V_{Tobj}$ (tp) on the angular velocity necessary to tilt the container at the elapsed time tp that is stored by the means 96 for storing data on the flow patterns.

$$V_{Tp}=f(T)\cdot V_{Tobj}(tp) \quad (1)$$

Where f(T): the correction factor for the angular velocity to tilt the container, T: the angle of the tilt at the center O for the movement of the ladle The arithmetical element 86 for instructions on the speed and the position of the shaft calculates the displacement of the mechanism 20 for moving the container back and forth, of the vertically moving machine 30, and of the mechanism 40 for tilting the container, based on the angular velocity $V_{Tp}$ necessary to tilt the container as specified by the instructions. It outputs the displacement to each device via the amplifier 74 for a driver for the shaft. Since each device 20, 30, 40 moves under the instructions that are sent by the arithmetical element 86 for instructions on the speed and the position of the shaft, the mechanism 40 for tilting the container tilts the ladle 2 by the angular velocity to tilt the container. Further, the tilting shaft 44 moves along an arc about the center O for the movement. That is, the controller 70 carries out feedforward control by using the angular velocity $V_{Tp}$ to tilt the container as specified by the instructions. Namely, the velocity $V_{Tp}$ is a value obtained by multiplying the angular velocity $V_{Tobj}$(tp) to tilt the container of the flow pattern by the correction factor f(T) for the angular velocity to tilt the container.

When the gating system is filled with the molten metal, the molten metal starts to fill the cavity. During the step of filling the cavity with the molten metal, first the ladle 2 is tilted based on the flow pattern. Up to this operation, the control is the same as that for the above-mentioned control in the initial pouring.

While the molten metal is being poured from the ladle 2 into the mold 100, the weight of the devices that include the ladle 2 is detected by means of the load cell 50. The means 87 for calculating the weight of the molten metal in the ladle continuously measures the weight of the molten metal in the ladle. Incidentally, the meaning of the wording "the load cell 50 detects the weight of the molten metal in the ladle 2" may include the operation where the means 87 for calculating the weight of the molten metal in the ladle calculates the weight of the molten metal in the ladle 2. The means 82 for calculating a correction to the pouring weight calculates the difference between the detected weight of the molten metal in the ladle 2 and the weight of the molten metal of the flow pattern, so as to output the correction to the pouring weight to the means 85 for calculating an angular velocity to tilt the ladle. The means 85 for calculating an angular velocity to tilt the ladle calculates the correction $V_{Tw}$ to the angular velocity to tilt the ladle by using Equation (2), based on the correction to the pouring weight and by using the correction factor cg for the pouring weight that is sent by the means 93 for storing parameters. Incidentally, the calculation within the mark "{ }" in Equation (2) is carried out by the means 82 for calculating a correction to the pouring weight.

$$V_{Tm}=cg\cdot\{g_{obj}(tp)\cdot g(tp)\} \quad (2)$$

Where cg: the correction factor for the pouring weight that introduces the angular velocity to tilt the ladle based on the correction to the pouring weight $g_{obj}$(tp): the pouring weight at the time tp of the flow pattern g(tp): the detected weight of the molten metal in the mold at the time tp The correction $V_{Tw}$ to the angular velocity to tilt the ladle is output to the arithmetical element 86 for instructions on the speed and the position of the shaft. The arithmetical element 86 for instructions on the speed and the position of the shaft outputs the respective corrections to the displacement to the mechanism 20 for moving the container back and forth, to the vertically moving machine 30, and to the mechanism 40 for tilting the container, to correct the angle T of the tilt of the ladle 2. That is, the controller 70 carries out feedback control by using the weight of the molten metal in the ladle 2 that is detected by means of the load cell 50.

While the molten metal is being poured from the ladle 2 into the mold 100, the camera 60 continuously takes the picture of the surface of melt at the pouring cup 110 of the mold 100. The data that is taken by the camera 60 is converted to the image data by means of the arithmetic unit 76 for image processing. The means 83 for calculating the area of the sprue calculates the area of the sprue. Then the means 84 for calculating a correction to the level of the surface of melt calculates the level of the surface of melt based on that area of the sprue and the parameters that are sent by the means 93 for storing parameters. Incidentally, the data on the surface of melt that are taken by the camera 60 are processed by the arithmetic unit 76 for image processing and the means 84 for calculating a correction to the level of the surface of melt to obtain the level of the surface of melt. The meaning of the wording "the camera 60 detects the level of the surface of melt at the pouring cup 110" may include the level of the surface of melt being calculated in the above-mentioned way. The means 84 for calculating a correction to the level of the surface of melt calculates the correction to the level of the surface of melt based on the difference between the calculated level of the surface of melt and the standard value that is sent by the means 94 for storing standard values on the level of the surface of melt. The means 85 for calculating an angular velocity to tilt the ladle calculates the correction $V_{Ts}$ to the angular velocity to tilt the container by using Equation (3) based on the correction to the level of the surface of melt and the correction factor cl for the level of the surface of melt that is sent by the means 93 for storing parameters. The calculation within the mark "{ }" in Equation (3) is carried out by the means 84 for calculating a correction to the level of the surface of melt.

$$V_{Ts}=Cl\cdot\{s_{obj}-s\} \tag{3}$$

where cl: the correction factor for the level of the surface of melt that introduces the angular velocity to tilt the ladle based on the correction to the level of the surface of melt $s_{obj}$: the standard value for the level of the surface of melt s: the level of the surface of melt that is detected by the camera The correction $V_{Ts}$ to the angular velocity to tilt the ladle is output to the arithmetical element 86 for instructions on the speed and the position of the shaft. The arithmetical element 86 for instructions on the speed and the position of the shaft sends the respective correction values for the displacement to the mechanism 20 for moving the container back and forth, the vertically moving machine 30, and the mechanism 40 for tilting the container, to correct the angle T of the tilt of the ladle 2. That is, the controller 70 carries out feedback control by using the level of the surface of melt at the pouring cup 110 of the mold 100, which level is detected by the camera 60.

When the end of the pouring is approaching, the time to stop the pouring is determined based on the weight of the molten metal in the ladle 2 that is detected by means of the load cell 50. The angle of the tilt of the ladle is returned to 0 (zero) based on the data on the angular velocity to tilt the container when the pouring, in line with the flow pattern, stops. Generally it is returned at the maximum velocity. In this case only the mechanism 40 for tilting the container may operate, and so the ladle 2 is not necessarily moved up and down and back and forth, so that the tilting shaft 44 moves along an arc about the center O for the movement.

The pouring rate from the ladle 2 into the mold 100 is adjusted by controlling the angle T of the tilt of the ladle 2 based on the flow pattern. At the same time the pouring rate from the ladle 2 into the mold 100 is adjusted by correcting the angle T of the tilt based on the weight of the molten metal in the ladle 2 that is detected by means of the load cell 50 and the level of the surface of melt at the pouring cup 110 of the mold 100 that is detected by means of the camera 60. Thus the correction shown as crossed-out areas in FIG. 7 is carried out. Because of this correction the molten metal can be poured into the mold for a proper pouring time to maintain the constant level of the surface of melt from the beginning to the end of the pouring and to maintain a necessary and sufficient pouring rate without a leak of the molten metal, an overflow, a shrinkage, or a short run at the end of the pouring.

In the above discussion the controller 70 carries out the calculations by the respective specific means. However, it does so by some other means. The configuration of the controller 70 is not limited.

The controller 70 may carry out other controls, such as the measurement of the time after the molten metal is received by the ladle 2, the measurement of the time after an alloyed metal or an inoculants is added, the control of the movement of the pouring machine 1, the detection of any abnormality of the voltage received, or the detection and generation of the alarm that ensures safe operations.

Figure 8:
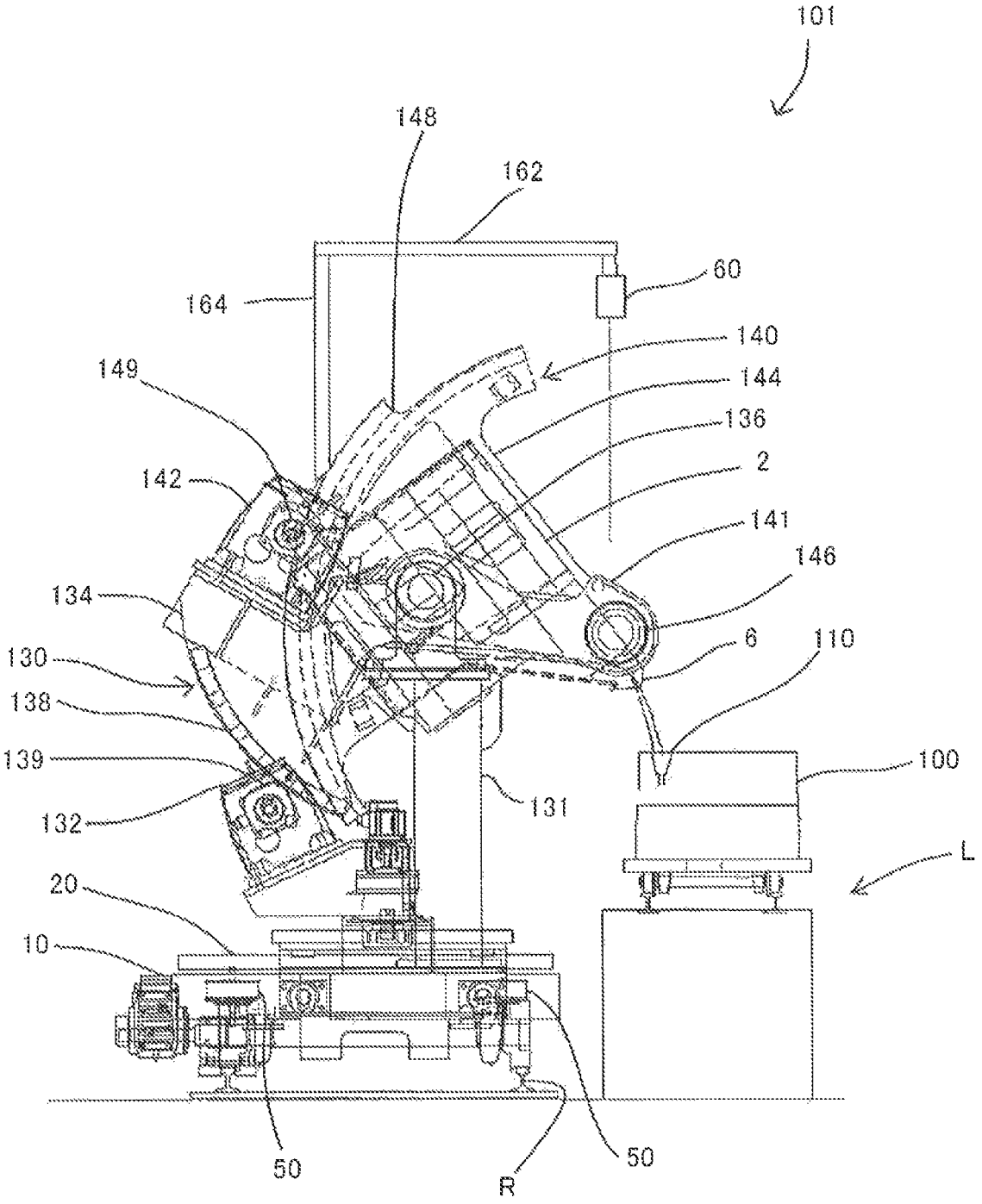
FIG. 8 is a front view of another pouring machine. It illustrates that molten metal is being poured from the ladle into the mold.

FIG. 8 is a front view of a pouring machine 101 that has a mechanism that differs from that of the pouring machine 1. Like the pouring machine 1, the mechanism 20 for moving the container back and forth is placed on the traveling bogie 10. A first mechanism 130 for tilting the container is placed on the mechanism 20 for moving the container back and forth. A second mechanism 140 for tilting the container is placed on the first mechanism 130 for tilting the container.

In the first mechanism 130 for tilting the container a pillar 131 and a first driver 132 for the tilting are fixed to the mechanism 20 for moving the container back and forth. A first tilting shaft 136 is rotatably supported at the top of the pillar 131. A first frame 134 for tilting is fixed to the first tilting shaft 136. A first sector gear 138 is fixed to the first frame 134 for tilting and is engaged with a first pinion 139 of the first driver 132 for the tilting. That is, when the first pinion 139 is rotated by means of the first driver 132 for the tilting, the first sector gear 138 and the first frame 134 for tilting are tilted about the first tilting shaft 136.

In the second mechanism 140 for tilting the container, a supporting plate 141 is supported so as not to move by means of the first tilting shaft 136 of the first mechanism 130 for tilting the container. Namely, the supporting plate 141 tilts together with the first tilting shaft 136. A second tilting shaft 146 is supported so as to be tilted at a position in the supporting plate 141 that is near the lip for pouring 6 of the ladle 2. A second frame 144 for tilting is fixed to the second tilting shaft 146. A second sector gear 148 is fixed to the second frame 144 for tilting at the side that is opposite the second tilting shaft 146 and is engaged with the second pinion 149 of the second driver 142 for the tilting. Namely, when the second pinion 149 is rotated by means of the second driver 142 for the tilting, the second sector gear 148 and the second frame 144 for tilting are tilted about the second tilting shaft 146. Incidentally, the second driver 142 for the tilting is supported by means of the first frame 134 for tilting.

The ladle 2 is supported by the second mechanism 140 for tilting the container. If the first mechanism 130 for tilting the container tilts, then the supporting plate 141 also tilts, so that the second tilting shaft 146 moves upside down. The second mechanism 140 for tilting the container tilts about the second tilting shaft 146. Thus the first mechanism 130 for tilting the container can move the ladle 2 up and down.

In the pouring machine 101 a frame 164 is provided to the mechanism 20 for moving the container back and forth. An arm 162 for the camera horizontally extends from the frame 164 to hold the camera 60. The frame 164 may be provided to the pillar 131.

In the pouring machine 101 the load cell 50 is placed between the traveling bogie 10 and the mechanism 20 for moving the container back and forth. The load cell 50 may be placed at another place if it detects the weight of the ladle 2. The controller 70 is provided like the pouring machine 1, although it is shown in FIG. 8.

By the pouring machine 101 the ladle 2 can be moved by means of the traveling bogie 10 to any position along the line of molds L. It can come close to, and move away from, the molds 100 by means of the mechanism 20 for moving the container back and forth. It can tilt about the first tilting shaft 136 by means of the first mechanism 130 for tilting the container and about the second tilting shaft 146 by means of the second mechanism 140 for tilting the container. Thus, since it is moved by means of the mechanism 20 for moving the container back and forth and tilted about the first tilting shaft 136 and about the second tilting shaft 146, the molten metal can be poured from the ladle 2 into the mold 100 to constantly maintain the position to be poured. The second tilting shaft 140 can be used as the center O for the movement of the pouring machine 1. The molten metal can be poured into the mold while the level of the surface of melt at the pouring cup 110 is detected by means of the camera 60 and while the weight of the molten metal in the ladle 2 is detected by means of the load cell 50.

The position of the camera 60 is preferably adjusted by means of the arm 162 for the camera depending on the positional relationship between the pouring machine 101 and the pouring cup 110. For example, the frame 164 may be configured to move depending on the tilting of the first mechanism 130 for tilting the container.

In the above discussion the molten metal is poured from the ladle 2 into the mold 100. However, the container 2 of the present invention may be a melting furnace or the like. For example, when cast steel is used for casting, the molten metal is preferably poured from the melting furnace into the mold without transferring the molten metal to the ladle, so that the metal is maintained at a high temperature. In this case, since the melting furnace is very heavy, the container 2, namely, the melting furnace, is not moved up and down, but the mold 100 is moved up and down to constantly maintain the position to pour the molten metal. That is, the pouring machine 1 may not be equipped with the vertically moving machine 30, but instead it may be equipped with a vertically moving machine (not shown) to move the mold 100 up and down.

Below, the main reference numerals and symbols that are used in the detailed description and drawings are listed.

1 The pouring machine
2 The ladle (the container)
4 The body
6 The lip for pouring
10 The traveling bogie
20 The mechanism for moving the container back and forth
30 The vertically moving machine
32 The pillar
34 The vertically moving body
36 The driver for moving the body up and down
40 The mechanism for tilting the container
42 The driver for the tilting
44 The tilting shaft
46 The table for the ladle
47 The side plate
48 The bottom plate
50 The load cell (the weight detector)
60 The camera (the surface-of-melt detector)
62 The arm for the camera
64 The frame
70 The controller
72 The central control unit
74 The amplifier for a driver for the shaft
76 The arithmetic unit for image processing
78 The amplifier for the load cell
80 The arithmetical section
81 The means for calculating a present position and a velocity of the shaft
82 The means for calculating a correction to the pouring weight
83 The means for calculating an area of the sprue
84 The means for calculating a correction to the level of the surface of melt
85 The means for calculating an angular velocity to tilt the ladle
86 The arithmetical element for instructions on the speed and the position of the shaft
87 The means for calculating the weight of the molten metal in the ladle
90 The storing section
91 The means for storing arithmetical data
92 The means for storing parameters on the elapsed time
93 The means for storing parameters
94 The means for storing standard values on the level of the surface of melt
95 The means for storing correction functions on the angle that the ladle tilts
96 The means for storing data on the flow patterns
97 The means for storing the data on the tare of the ladle
100 The molds
110 The pouring cup
112 The taper on the pouring cup
130 The first mechanism for tilting the container
131 The pillar
132 The first driver for the tilting
134 The first frame for tilting
136 The first tilting shaft
138 The first sector gear
139 The first pinion
140 The second mechanism for tilting the container
141 The supporting plate
142 The second driver for the tilting
144 The second frame for tilting
146 The second tilting shaft
148 The second sector gear
149 The second pinion
162 The arm for the camera
164 The frame
L The line of molds
O The center for the movement (the virtual point)
R The rail
T The angle of the tilt

The invention claimed is:

1. A pouring machine that pours molten metal from a container into molds that are transported in a line comprising:

a traveling bogie that travels along the molds that are transported in a line;

a mechanism for moving the container back and forth that is placed on the traveling bogie and that moves the container in a direction whereby it comes close to, or moves away from, the molds that are transported in a line;

a mechanism for tilting the container that is placed on the mechanism for moving the container back and forth and that tilts the container;

a weight detector that detects a weight of molten metal in the container;

a surface-of-melt detector that is placed on the traveling bogie and that detects a level of a surface of melt in a pouring cup of a mold that receives molten metal from the container; and a controller that controls an angle of tilt of the container by using the level of the surface of melt that is detected by the surface-of-melt detector and a weight of molten metal that is detected by the weight detector;

wherein the controller stores a flow pattern that is suitable for the mold, the flow pattern including data on an angular velocity to tilt the container at each time interval and data on pouring weights at each time interval, and wherein the controller controls the angle of the tilt of the container based on the angular velocity, to tilt the container.

2. The pouring machine of claim 1, wherein the surface-of-melt detector is an image sensor.

3. The pouring machine of claim 2, wherein a taper is formed on the pouring cup so that the surface-of-melt detector detects the level of the surface of melt based on an area of the surface of melt.

4. The pouring machine of claim 1, wherein the container is a ladle that receives molten metal from a furnace and pours the molten metal into the molds, wherein a vertically moving machine that moves the ladle up and down is placed on the mechanism for moving the container back and forth, wherein the mechanism for tilting the container is placed on the vertically moving machine.

5. The pouring machine of claim 4, wherein the mechanism for moving the container back and forth, the vertically moving machine, and the mechanism for tilting the container, coordinate with each other so that a tilting shaft about which the container is tilted by means of the mechanism for tilting the container moves along an arc about a virtual point that is set at or near a point where molten metal drops from a lip for pouring of the container, so as to maintain a constant position where the molten metal is poured from the container into the mold.

6. The pouring machine of claim 1, wherein the controller further stores a correction function to match the angular velocity to tilt the container of the flow pattern with a shape of the container so as to use a value that is obtained by multiplying the angular velocity to tilt the container by the correction function.

7. The pouring machine of claim 6, wherein the controller carries out feedforward control by using the value that is obtained by multiplying the angular velocity to tilt the container by the correction function and carries out feedback control by using the level of the surface of melt that is detected by means of the surface-of-melt detector and a weight of the molten metal that is detected by the weight detector.

8. The pouring machine of claim 1, wherein the controller calculates a correction to the angular velocity to tilt the container by using a difference between data on the pouring weight of the flow pattern and a weight of the molten metal in the container that is detected by the weight detector, to control the angle of the tilt of the container.

9. The pouring machine of claim 8, wherein the controller stores a correction factor for the pouring weight to calculate the correction to the angular velocity to tilt the container based on the difference in weight, and wherein the controller calculates the correction to the angular velocity to tilt the container by multiplying the difference in weight by the correction factor for the pouring weight.

10. The pouring machine of claim 1, wherein the controller calculates the correction to the angular velocity to tilt the container so that the level of the surface of melt that is detected by means of the surface-of-melt detector is a predetermined level of the surface of melt, to control the angle of the tilt of the container.

11. The pouring machine of claim 10, wherein the controller stores the correction factor for the level of the surface of melt, which correction factor is used for calculating the correction to the angular velocity to tilt the container based on the difference between the level of the surface of melt that is detected by means of the surface-of-melt detector and the predetermined level of the surface of melt, and wherein the controller calculates the correction to the angular velocity to tilt the container by multiplying the difference in level by the correction factor for the level of the surface of melt.

* * * * *